United States Patent [19]

Shiraishi et al.

[11] Patent Number: 4,853,862

[45] Date of Patent: Aug. 1, 1989

[54] METHOD AND APPARATUS FOR CONTROLLING AIR-FUEL RATIO IN AN INTERNAL COMBUSTION ENGINE BY CORRECTIVE FEEDBACK CONTROL

[75] Inventors: Takashi Shiraishi, Katsuta; Taiji Hasegawa, Nakaminato, both of Japan

[73] Assignee: Hitachi, Ltd., Tokyo, Japan

[21] Appl. No.: 820,739

[22] Filed: Jan. 22, 1986

[30] Foreign Application Priority Data

Jan. 23, 1985 [JP] Japan ..... 60-9061

[51] Int. Cl.[4] ..... F02D 41/14; F02D 41/26; F02M 51/00

[52] U.S. Cl. ..... 364/431.05; 123/440; 123/489

[58] Field of Search ..... 364/431.05, 431.06, 364/830, 831; 123/440, 489

[56] References Cited

U.S. PATENT DOCUMENTS

| | | | |
|---|---|---|---|
| 3,404,262 | 10/1968 | Udall | 364/830 |
| 3,541,318 | 11/1970 | Miller | 364/831 |
| 4,178,884 | 12/1979 | Norimatsu et al. | 123/489 |
| 4,210,106 | 7/1980 | Wessel et al. | 123/489 |
| 4,337,745 | 7/1982 | Pomerantz | 123/489 |
| 4,373,187 | 2/1983 | Ishii et al. | 364/431.06 |
| 4,402,291 | 9/1983 | Aono | 123/440 |
| 4,528,962 | 7/1985 | Auth | 123/440 |
| 4,584,982 | 4/1986 | Clement et al. | 123/489 |
| 4,616,619 | 10/1986 | Saito et al. | 123/489 |
| 4,617,901 | 10/1986 | Otobe et al. | 123/489 |

*Primary Examiner*—Felix D. Gruber
*Attorney, Agent, or Firm*—Antonelli, Terry & Wands

[57] ABSTRACT

A method of controlling air-fuel ratio in which addition or subtraction is carried out on the basis of the output of an exhaust gas sensor to determine a feedback constant by which the air-fuel ratio is feedback-controlled. The feedback constant is changed at a given regular interval.

9 Claims, 3 Drawing Sheets

METHOD AND APPARATUS FOR CONTROLLING AIR-FUEL RATIO IN AN INTERNAL COMBUSTION ENGINE BY CORRECTIVE FEEDBACK CONTROL

BACKGROUND OF THE INVENTION

The present invention relates to the control of the air-fuel ratio of an engine and, more particularly, to the shift of the air-fuel ratio (λ).

A feedback control method is, for example, disclosed in the specification of Japanese Patent Laid-Open No. 48738/1977, which includes the steps of detecting the condition of exhaust gas from an engine by an exhaust gas sensor, integrating the output of the sensor while changing the integration direction in accordance with the detected exhaust gas condition, and correcting the amount of fuel supplied to the engine on the basis of the result of the integration.

According to the method disclosed in the above specification, a predetermined value is added to or subtracted from the result of the integration simultaneously with the change of integration directions. The response of control is improved by the addition or subtraction thus carried out. This prior art method, however, has the disadvantage that it is extremely difficult to adjust the air-fuel ratio to match the engine speed.

As the engine speed increases, the lean-rich inverting time of the exhaust gas condition is decreased. In consequence, the rate of the degree of influence by the delay in control changes, so that, as the engine speed changes, the air-fuel ratio is offset in one direction.

Feedback control needs to be carried out in consideration of the above phenomenon, and it is difficult to adjust the air-fuel ratio so to match the engine speed.

In order to solve this problem, it has been proposed to vary the integral slope or integration gradient of the feedback control value; however, this produces additional problems in that variation of the integration gradient affects the ability to adequately reduce harmful components in the exhaust gas.

SUMMARY OF THE INVENTION

It is an object of the present invention to provide an air-fuel ratio control apparatus which enables the air-fuel ratio to be easily adjusted so as to match the engine speed and permits stable control to be obtained.

To this end, the present invention provides a method and apparatus wherein addition or subtraction of an additional correction component to the feedback constant is carried out on the basis of the output of an exhaust gas sensor to determine a corrected feedback constant by which the air-fuel ratio is feedback-controlled. In this method, the feedback constant is changed at a given regular interval, while the integral slope or integration gradient is maintained at a predetermined optimum value.

The above method and apparatus of the present invention advantageously makes it possible to shift the air-fuel ratio smoothly. In addition, since the shift is effected independently of the above addition or subtraction, the adjustment is facilitated.

DESCRIPTION OF THE PREFERRED EMBODIMENT

Figure 2:
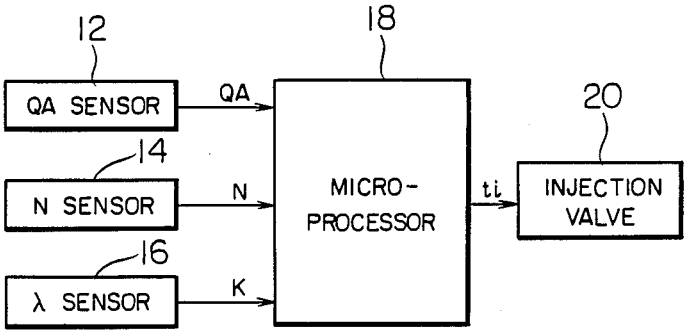
FIG. 2 is a system diagram.

Referring first to FIG. 2, which shows the fundamental arrangement of one embodiment of the present invention, a microprocessor 18 is supplied with, as its inputs, the output QA of an intake air quantity sensor (QA sensor) 12 and the output N of an engine speed sensor (N sensor) 14 so as to calculate a load Tp. The load Tp is expressed by the following formula:

$$Tp = \frac{QA}{N} \tag{1}$$

In addition, the output K of a λ sensor 16 which detects the condition of the oxygen concentration in exhaust gas is input to the microprocessor 18 to calculate a feedback contant M. The fuel injection quantity ti is expressed by the following formula:

$$ti = Tp \cdot M \tag{2}$$

where M represents the feedback constant.

Fuel is supplied from an injection valve 20 on the basis of the fuel injection quantity ti.

Figure 3:
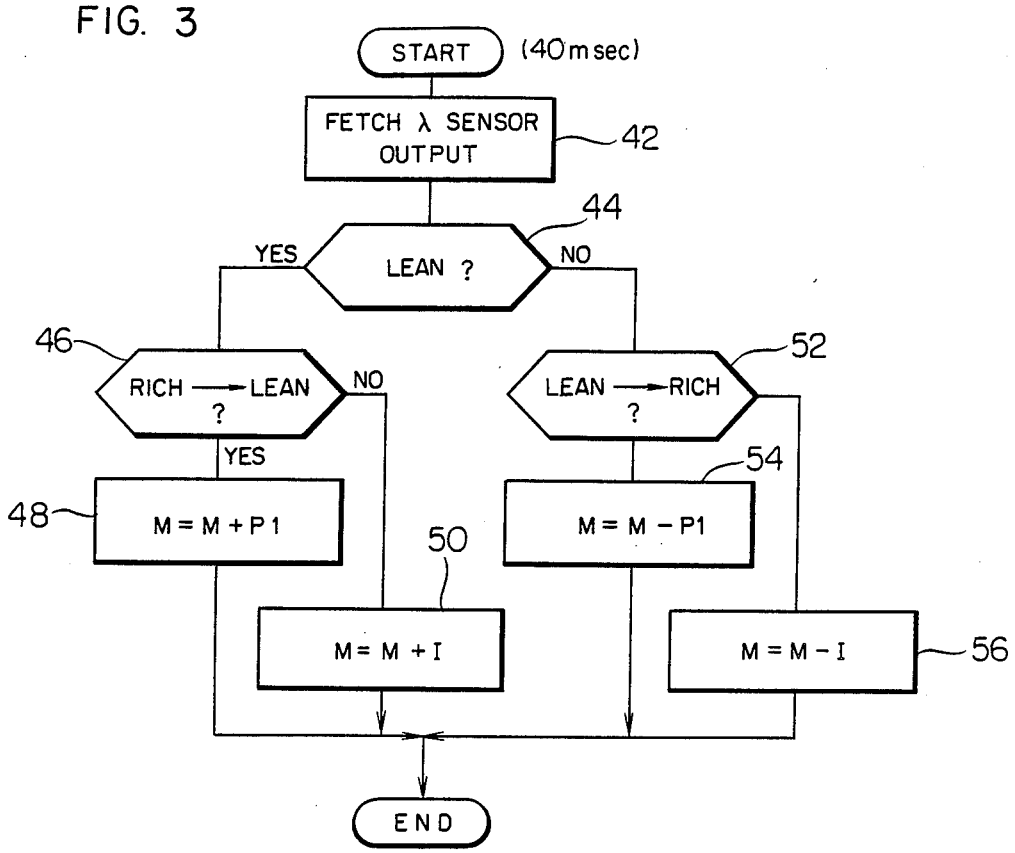
FIG. 3 is a flow chart for calculating the feedback constant M.

FIG. 3 is a flow chart employed to calculate the feedback constant M. The control process according to this flow chart is executed regularly at intervals of 40 msec. The output of the λ sensor is fetched in Step 42, and is compared with a reference level in Step 44 to determine whether the exhaust gas is lean or rich. If the exhaust gas is judged to be lean, a judgement is made in Step 46 as to whether or not the exhaust gas was judged to be rich in the last control process and is judged to be lean in this process. If YES, a proportional portion P1 is added to the feedback constant M in Step 48.

Figure 4:
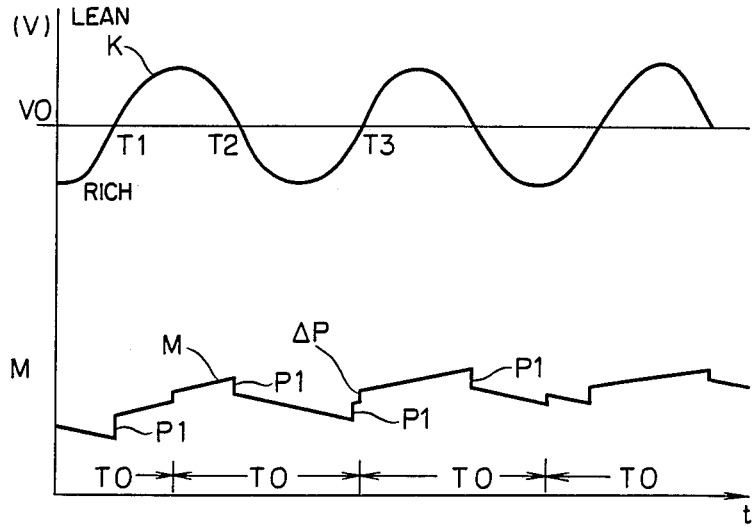
FIG. 4 shows the operation of the embodiment.

The above operation is shown in FIG. 4 in which the exhaust gas is judged to be lean when the output K of the λ sensor is larger than a reference value V0, and is judged to be rich when the output K is smaller than the value V0. When the exhaust gas changes from a rich state to a lean state at the time T1, the proportional portion P1 is added to the feedback constant M in Step 48. If the answer of the judgement made in Step 46 is that the exhaust gas was judged to be lean in the last control process and is also judged to be lean in this process, a predetermined value I is added to the feedback constant M in step 50. Accordingly, the feedback constant M increases at a constant rate from the time T1 to the time T2.

If the exhaust gas is judged to be rich in Step 44, a judgement is made in Step 52 as to whether or not the exhaust gas was judged to be lean in the last control process. If the exhaust gas was judged to be lean in the last control process and is judged to be rich in this process, this applies to a control operation effected, for example, at the time T2 at which the proportional portion P1 is subtracted from the feedback constant M in Step 54. If the exhaust gas was judged to be rich in the last control process and is also judged to be rich in this process, the value I is subtracted from the feedback constant M in Step 56. As a result, the feedback constant M decreases at a constant rate from the time T2 to the time T3.

Figure 1:
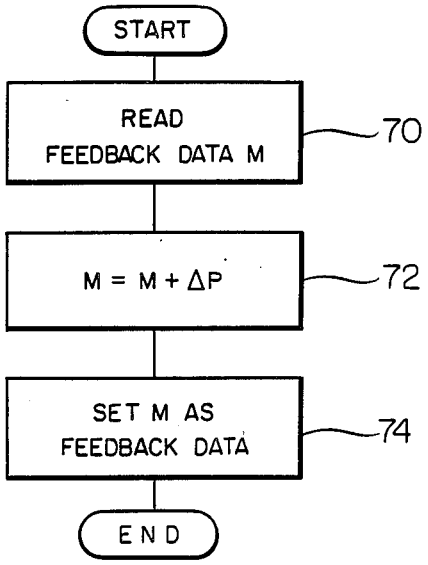
FIG. 1 is a flow chart of one embodiment of the present invention for shifting the feedback constant.

The following is a description of the flow chart shown in FIG. 1. The control process according to this flow chart is executed at a regular interval of time T0, which is, for example, 400 msec.

The feedback constant M described in relation to FIGS. 3 and 4 is read out from a RAM in Step 70, and ΔP is added to the feedback constant M in Step 72. Then, in Step 74, the result of this addition is set in the RAM used in the process carried out according to the flow chart shown in FIG. 3. Accordingly, the feedback constant M increases by ΔP at the regular interval T0 as shown in FIG. 4. The value for ΔP is determined so that the air-fuel ratio matches the engine speed, and therefore, ΔP takes a positive or negative value. When ΔP takes a negative value, the feedback constant M shown in FIG. 4 decreases by ΔP at the regular interval T0.

ΔP may be variable, and values therefor may be stored in a memory in the form of a table. In such a case, either or both of the engine speed N and the load Tp are employed as parameters. In this case, a value for ΔP in accordance with the parameter(s) is retrieved from the table in Step 72 and is added to the feedback constant M.

According to the present invention, it is easy to adjust the air-fuel ratio to match the engine speed.

Figure 5:
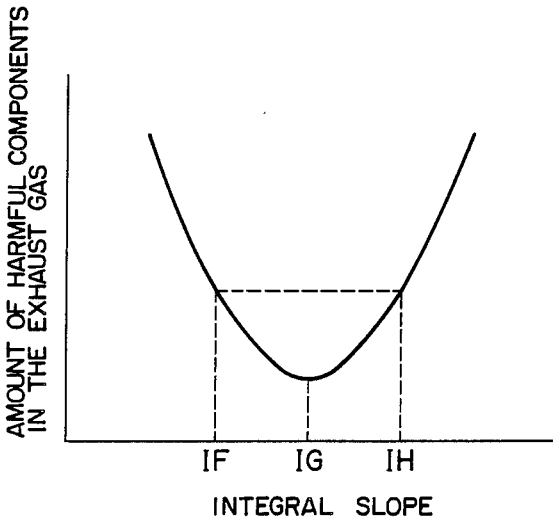
FIG. 5 shows a relation between the integral slope and the amount of harmful components in the exhaust gas.

According to a conventional method, the integration is executed with slopes as shown in FIG. 4, but an integral slope when the air-fuel ratio is lean is different from the integral slope when the air-fuel ratio is rich. Therefore, in the conventional method the values I at steps 50 and 56 are different from each other. FIG. 5 shows the relation between the integral slope (integration gradient) and the amount of harmful components in the exhaust gas, which is obtained by experiment. As seen from FIG. 5, the integral slope IG is the optimum value. Since the conventional method uses different integral slopes between during lean and during rich, two values IF and IH on the both sides of the value IG are used as the integral slopes to obtain a preferable integral slope. However, it is difficult to determine the values IF and IH, since many experiments are required. On the other hand, according to this invention, the value IG which can be very easily obtained by measuring the exhaust gas can be used without variation as the integral slope; as result, it is easy to adjust the air-fuel ratio to match the engine speed.

We claim:

1. An air-fuel ratio control system for an engine comprising:

exhaust gas sensor means for detecting a state of exhaust gas so as to produce an output signal indicating a state of an air-fuel ratio of the engine;

a processor unit for calculating a control value on the basis of the state of the exhaust gas by:

(a) comparing said output signal of said exhaust gas sensor with a predetermined value so as to produce a comparison result;

(b) generating in response to said comparison result a control signal having a first proportional correction component at a first period and a predetermined integral slope; and (c) correcting said control signal by periodically adding a second proportional correction component thereto at a second period which is longer than said first period; and means for controlling said air-fuel ratio on the basis of said corrected control signal.

2. A system according to claim 1, wherein said first period is of a fixed predetermined length and said second period varies with engine speed.

3. A system according to claim 1, wherein said further proportional correction component has a value which varies with engine speed.

4. A system according to claim 1, wherein said further proportional correction component has a value which varies with engine load.

5. A system according to claim 1, wherein said processor unit operates to add said second proportional correction component at a selected interval which is not related to the timing of the output of said exhaust gas sensor, while maintaining the value of said predetermined integral slope without change.

6. A method of controlling an air-fuel ratio for an engine comprising the steps of:

(a) detecting an output of an $O_2$ sensor;

(b) comparing an output of said $O_2$ sensor which indicates a state of an air-fuel ratio of the engine with a predetermined value so as to produce a comparison result;

(c) generating a control signal having a first proportional correction component and a predetermined integral slope based on said comparison result of the comparison in step (a), said steps (a), (b) and (c) being executed periodically at a first period;

(d) adding a second proportional correction component to said control signal generated in step (c), to produce a corrected control signal, said step (d) being executed periodically at a second period which is longer than said first period; and (e) controlling the air-fuel ratio on the basis of said corrected control signal.

7. A method according to claim 6, wherein said second proportional correction component is added to said control signal while maintaining said predetermined integral slope without change.

8. A method according to claim 6, wherein said second proportional correction component has a value which varies with engine speed.

9. A method according to claim 6, wherein said second proportional correction component has a value which varies with engine load.

* * * * *